US009211045B2

(12) United States Patent
Li et al.

(10) Patent No.: US 9,211,045 B2
(45) Date of Patent: Dec. 15, 2015

(54) AUTONOMOUS COVERAGE VACUUM CLEANER HAVING ROLLER BRUSH CAPABLE OF RESILIENT VERTICAL DISPLACEMENT AND ROLLER BRUSH FRAME UNIT FOR THE SAME

(71) Applicant: EGENPOWER INC., Laguna Niguel, CA (US)

(72) Inventors: Gary Li, Dong Guan (CN); Sheng-Chan Chiu, Burnaby (CA)

(73) Assignee: Egenpower Inc., Laguna Niguel, CA (US)

( * ) Notice: Subject to any disclaimer, the term of this patent is extended or adjusted under 35 U.S.C. 154(b) by 394 days.

(21) Appl. No.: 13/743,050

(22) Filed: Jan. 16, 2013

(65) Prior Publication Data

US 2014/0137367 A1 May 22, 2014

(30) Foreign Application Priority Data

Nov. 20, 2012 (CN) ..... 2012 1 0475853

(51) Int. Cl.

| | |
|---|---|
| ***A47L 5/00*** | (2006.01) |
| ***A47L 9/04*** | (2006.01) |
| ***A47L 9/06*** | (2006.01) |
| ***A47L 5/34*** | (2006.01) |
| *A47L 11/40* | (2006.01) |

(52) U.S. Cl.

CPC ..... *A47L 9/0494* (2013.01); *A47L 5/34* (2013.01); *A47L 11/4058* (2013.01); *A47L 11/4041* (2013.01); *A47L 2201/00* (2013.01)

(58) Field of Classification Search

CPC ..... A47L 5/34; A47L 9/0494; A47L 2201/00; A47L 11/4058

USPC ..... 15/371, 368

See application file for complete search history.

(56) References Cited

U.S. PATENT DOCUMENTS

| | | | | |
|---|---|---|---|---|
| 2,416,420 | A * | 2/1947 | Taylor | 15/372 |
| 4,976,003 | A * | 12/1990 | Williams | 15/372 |
| 6,581,239 | B1 * | 6/2003 | Dyson et al. | 15/340.3 |
| 6,934,993 | B1 * | 8/2005 | Huffman et al. | 15/322 |
| 7,200,892 | B2 * | 4/2007 | Kim | 15/319 |
| 8,166,608 | B2 * | 5/2012 | Becker et al. | 15/372 |
| 2012/0169497 | A1 * | 7/2012 | Schnittman et al. | 340/540 |

FOREIGN PATENT DOCUMENTS

DE 102010000577 A1 * 8/2011

* cited by examiner

*Primary Examiner* — Bryan R Muller

(74) *Attorney, Agent, or Firm* — Muncy, Geissler, Olds & Lowe, P.C.

(57) ABSTRACT

Provided are an autonomous coverage vacuum cleaner and a roller brush frame unit for use therewith. The autonomous coverage vacuum cleaner includes a body, the roller brush frame unit, and at least a roller brush. The roller brush frame unit includes a roller brush frame, a connection frame, and a resilient connection element. The connection frame is disposed at a bottom of the body. The resilient connection element is connected between the roller brush frame and the connection frame. The roller brush frame moves vertically relative to the connection frame and the body when subjected to an external force. The roller brush is rotatably disposed at the roller brush frame. The roller brush frame unit enables the roller brush of the autonomous coverage vacuum cleaner to lift and drop resiliently and automatically according to the condition of the floor.

8 Claims, 7 Drawing Sheets

AUTONOMOUS COVERAGE VACUUM CLEANER HAVING ROLLER BRUSH CAPABLE OF RESILIENT VERTICAL DISPLACEMENT AND ROLLER BRUSH FRAME UNIT FOR THE SAME

BACKGROUND OF THE INVENTION

1. Technical Field

The present invention relates to autonomous coverage vacuum cleaners, and more particularly, to an autonomous coverage vacuum cleaner having a roller brush capable of resilient vertical displacement and a roller brush frame unit for the same.

2. Description of Related Art

During its autonomous journey, a conventional autonomous coverage vacuum cleaner gathers dust and debris from the floor with a roller brush disposed at its bottom and rotating about an axle mounted on the bottom and positioned parallel to the floor, wherein the dust and debris is sucked into a vacuum cleaning apparatus and then collected by a dust-collecting apparatus. The roller brush of the conventional autonomous coverage vacuum cleaner is rotatably disposed at a roller brush frame. The roller brush frame is fixedly disposed at a body of the autonomous coverage vacuum cleaner. As a result, the roller brush can only rotate but cannot move relative to the body.

In case a floor is uneven or has an obstacle, the roller brush, which comes into contact with the floor inevitably, is likely to be confronted with hindrance to thereby prevent the autonomous coverage vacuum cleaner from moving smoothly. For instance, the autonomous coverage vacuum cleaner is seldom able to cross the edge of a carpet, and thus the autonomous coverage vacuum cleaner is unable to move onto the carpet and may even come to a halt. Even if the autonomous coverage vacuum cleaner manages to move onto the carpet, the aforesaid hindrance will prevent the edge of the carpet from being thoroughly cleaned.

SUMMARY OF THE INVENTION

In view of the aforesaid drawbacks of the prior art, it is an objective of the present invention to provide an autonomous coverage vacuum cleaner and a roller brush frame unit for use with the autonomous coverage vacuum cleaner. The roller brush frame unit enables a roller brush of the autonomous coverage vacuum cleaner to lift and drop resiliently and automatically according to the condition of the floor and thereby the passage and cleaning performance of the autonomous coverage vacuum cleaner.

In order to achieve the above and other objectives, the present invention provides an autonomous coverage vacuum cleaner having a roller brush capable of lifting and dropping resiliently. The autonomous coverage vacuum cleaner comprises a body, a roller brush frame unit, and at least a roller brush. The roller brush frame unit comprises a roller brush frame, a connection frame, and a resilient connection element. The connection frame is disposed at the bottom of the body. The resilient connection element is connected between the roller brush frame and the connection frame, such that the roller brush frame moves vertically relative to the connection frame and the body when subjected to an external force. The roller brush rotatably disposed at the roller brush frame Accordingly, the roller brush is connected to the body by means of the roller brush frame unit, such that the autonomous coverage vacuum cleaner in operation can come into contact with a floor and perform a cleaning operation thereon.

If the autonomous coverage vacuum cleaner works on an uneven floor or is confronted with an obstacle, an external force exerted by the floor or the obstacle on the roller brush will be indirectly transmitted to the roller brush frame. With the roller brush frame being capable of moving vertically relative to the connection frame and the body because of the resilience of the resilient connection element, the roller brush can lift and drop in order to fit the uneven surface of the floor. Therefore, the roller brush is not only capable of passing an obstacle easily, but is also capable of cleaning thoroughly a location which might otherwise not be accessible. Hence, the roller brush frame unit enables a roller brush of the autonomous coverage vacuum cleaner to lift and drop resiliently and automatically according to the condition of the floor and thereby enhances the passage and cleaning performance of the autonomous coverage vacuum cleaner.

Detailed structures, features, assembly, and operation of an autonomous coverage vacuum cleaner having a roller brush capable of resilient vertical displacement and a roller brush frame unit for the same, which are provided by the present invention, are illustrated with embodiments hereunder. However, persons skilled in the art are able to understand that the detailed description and specific embodiments below are illustrative of the present invention, rather than restrictive of the claims of the present invention.

DETAILED DESCRIPTION OF THE PREFERRED EMBODIMENTS

Figure 1:
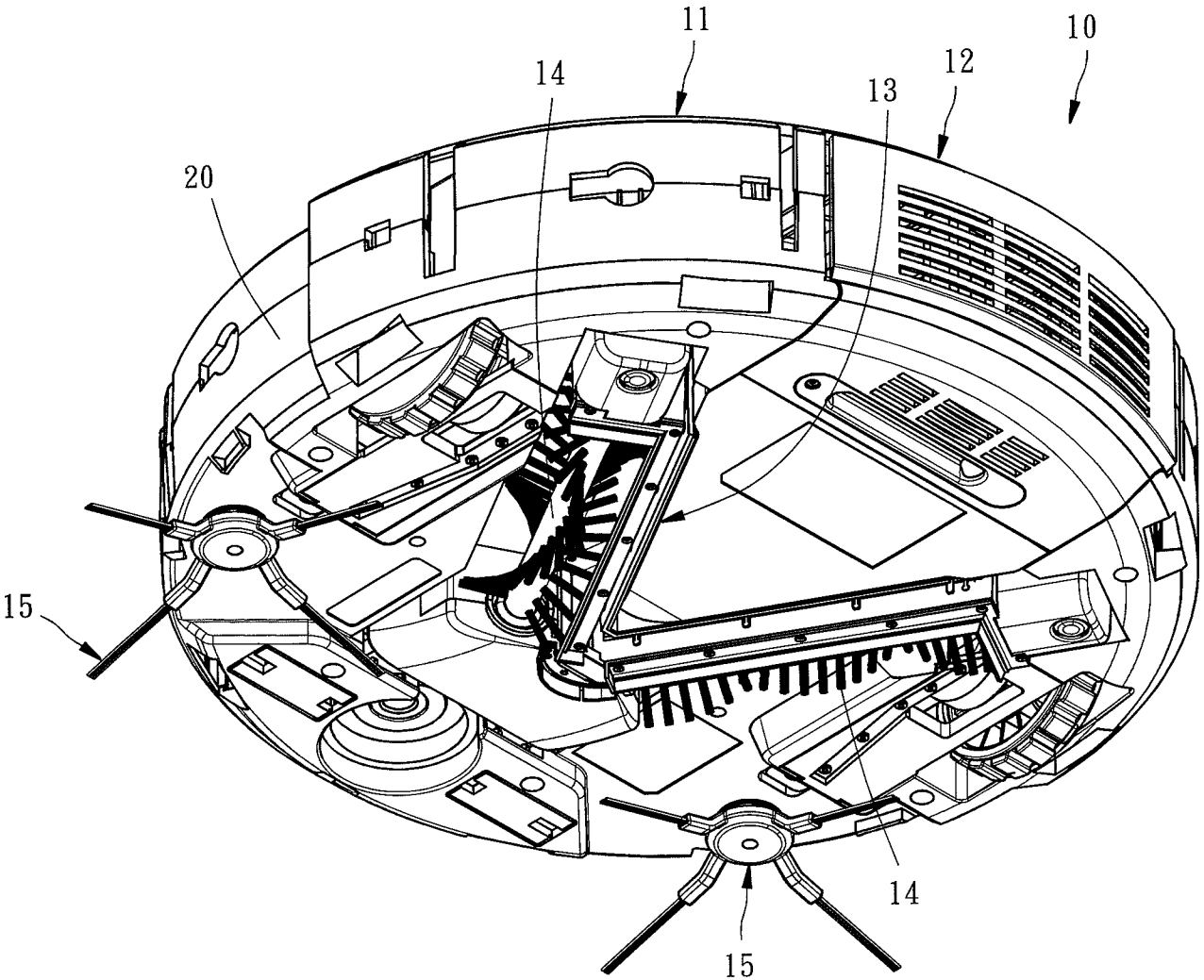
FIG. 1 is a perspective assembled view of an autonomous coverage vacuum cleaner having a roller brush capable of lifting and dropping resiliently according to a preferred embodiment of the present invention.

Referring to FIG. 1, in a preferred embodiment of the present invention, an autonomous coverage vacuum cleaner 10 comprises a body 11, a dust-sucking and dust-collecting apparatus 12 disposed at a bottom of the body 11, two roller brush frame units 13 which flank the dust-sucking and dust-collecting apparatus 12, two roller brushes 14 rotatably disposed at the roller brush frame units 13, respectively, and two edge cleaning heads 15 partially protruding from the body 11.

The body 11 is not only capable of moving across the floor in an automated manner, but is also capable of detecting an obstacle and thus turning aside automatically. The edge cleaning heads 15 sweep dust and debris from the portion of the floor which lies at the periphery of the body 11 to thereby sweep the dust and debris to the space between the body 11 and the floor, while the body 11 is moving. With the roller brushes 14, the dust and debris between the body 11 and the floor is swept upward. The dust-sucking and dust-collecting apparatus 12 sucks and collects the dust and debris. The essential technical features of the present invention are attributed to the roller brush frame units 13 as well as the junction of the body 11 and the roller brush frame units 13, and thus the other components of the present invention are not described in detail herein.

Figure 2:
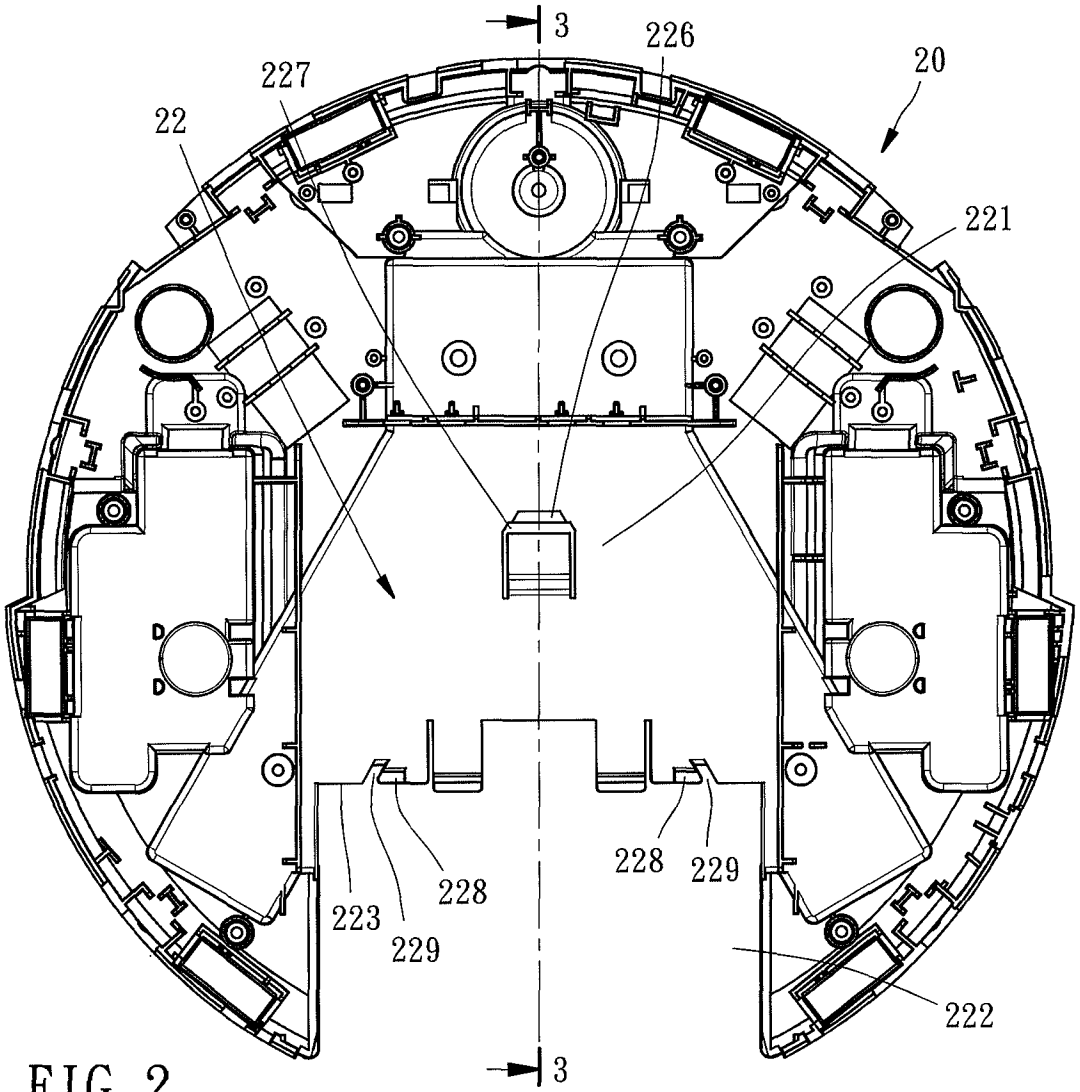
FIG. 2 is a top view of a lower casing of the autonomous coverage vacuum cleaner according to the preferred embodiment of the present invention.
Figure 3:
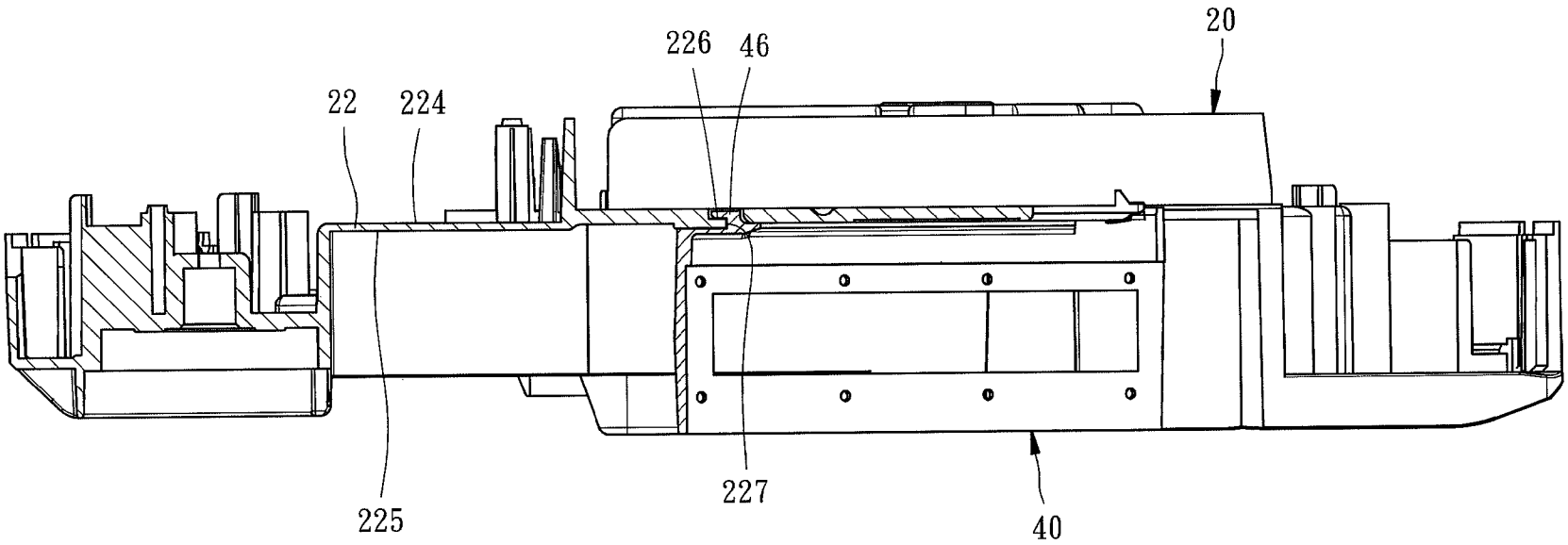
FIG. 3 is a cross-sectional view of the lower casing taken along line 3-3 of FIG. 2, showing that a connection frame disposed at the lower casing.

The body 11 comprises a lower casing 20 shown in FIG. 1 through FIG. 3. The lower casing 20 has a bottom board 22. The bottom board 22 has a central area 221, a hollowed-out area 222 where the dust-sucking and dust-collecting apparatus 12 is positioned, and an edge 223 defining the hollowed-out area 222. Furthermore, the bottom board 22 has an upper surface 224, a lower surface 225, a first recess 226 positioned at the central area 221 and dented from the upper surface 224, a first groove 227 disposed at the central area 221 and penetrating the upper and lower surfaces 224, 225, two second recesses 228 disposed at the edge 223 and dented from the upper surface 224, and two second grooves 229 disposed at the edge 223 and penetrating the upper and lower surfaces 224, 225. The first recess 226 is in communication with the first grooves 227. The two second recesses 228 are in communication with the two second grooves 229.

Figure 4:
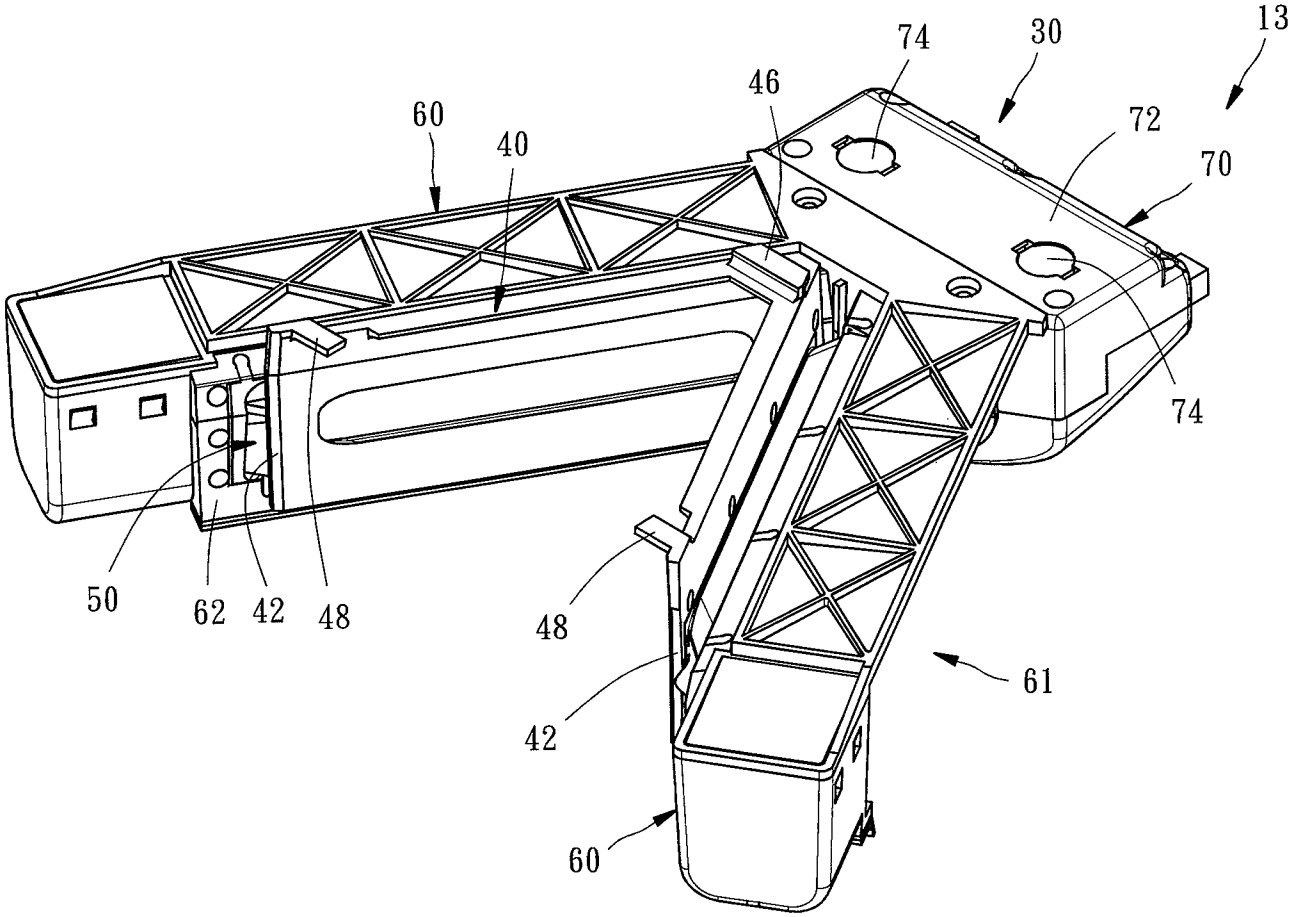
FIG. 4 is a perspective assembled view of a roller brush frame unit according to the preferred embodiment of the present invention.
Figure 5:
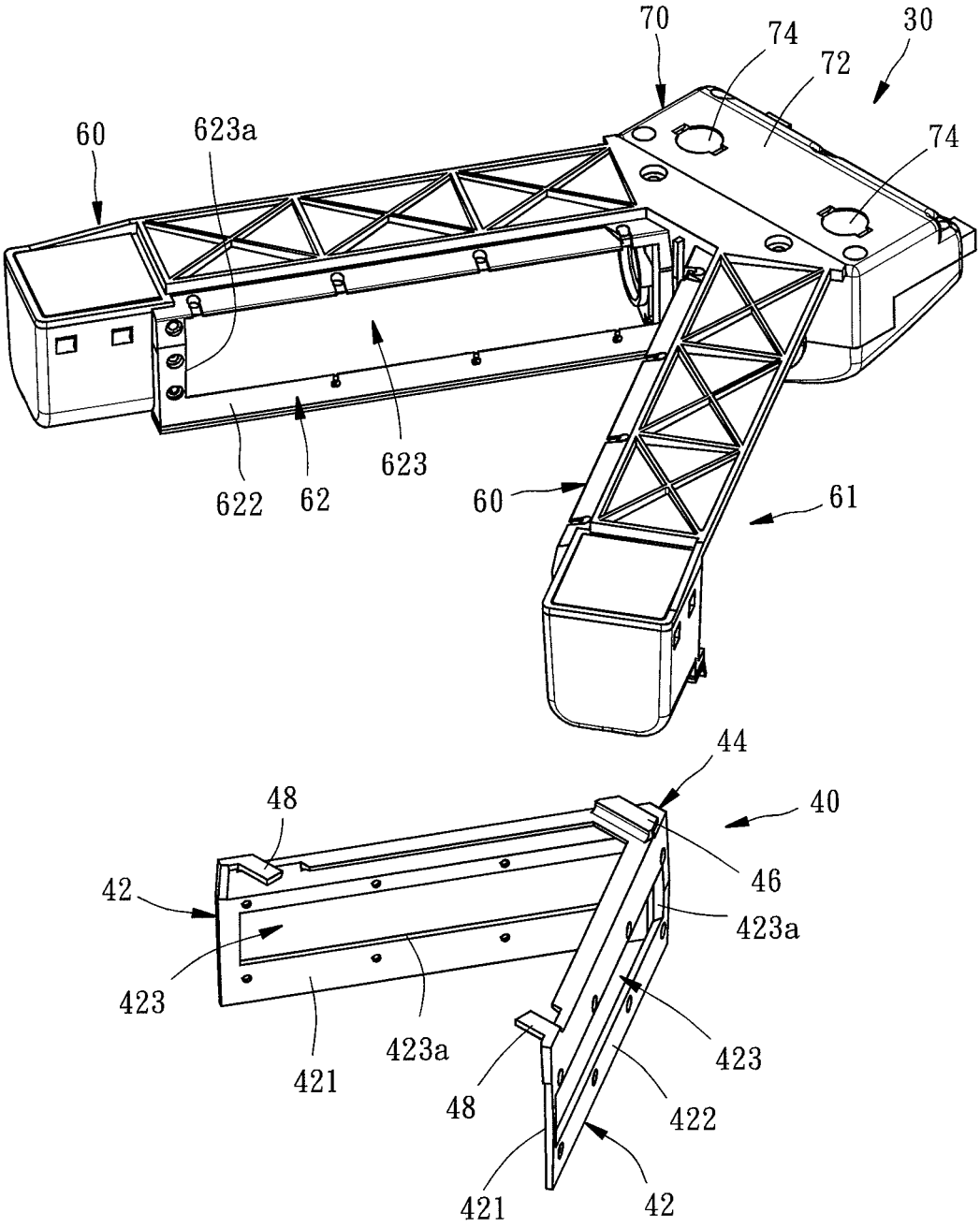
FIG. 5 is a perspective disassembled view of the roller brush frame unit according to the preferred embodiment of the present invention, wherein a resilient connection element of the roller brush frame unit is removed for the sake of illustration.
Figure 6:
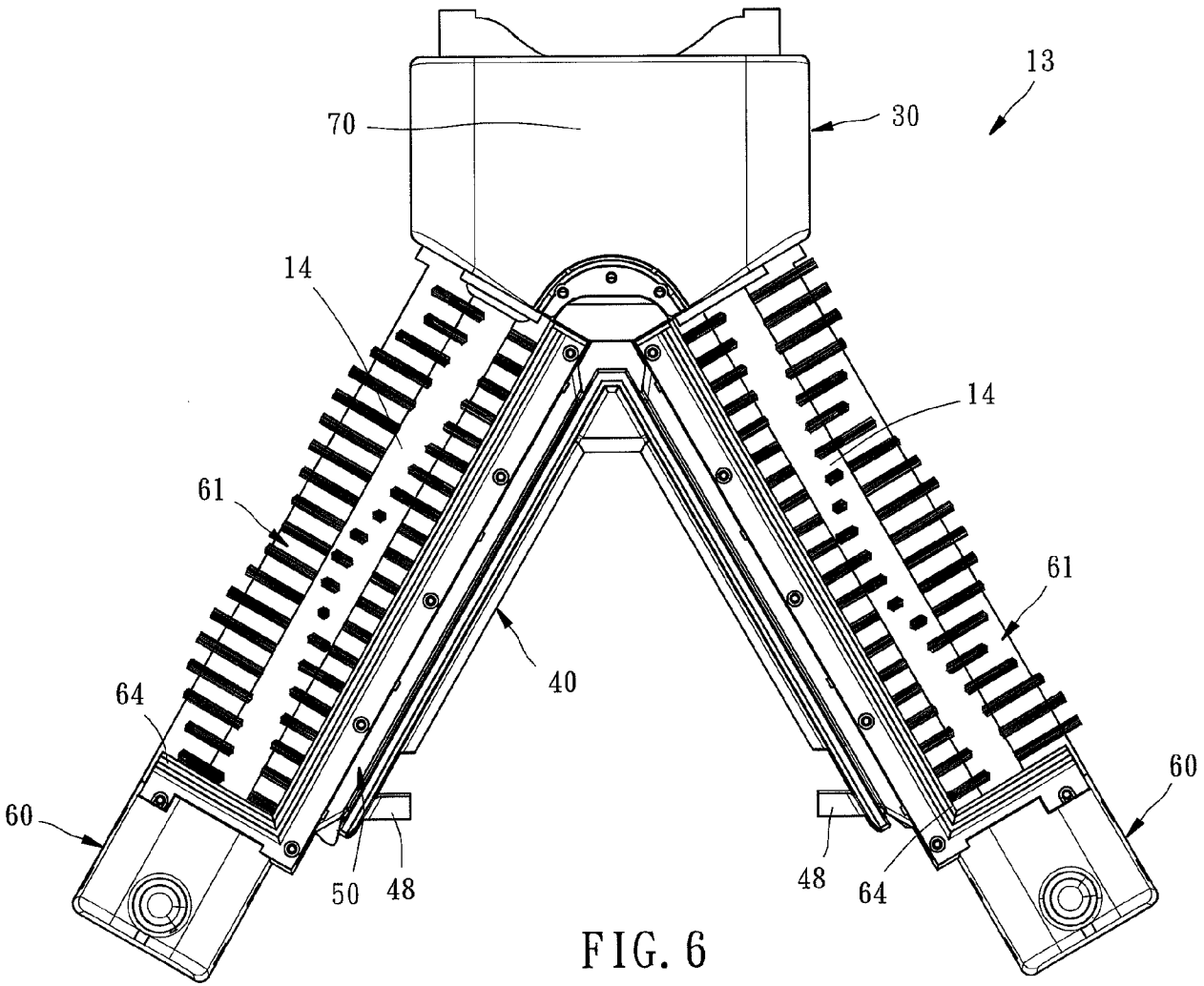
FIG. 6 is a bottom view of the roller brush frame unit and two roller brushes according to the preferred embodiment of the present invention.

Referring to FIG. 4 through FIG. 6, the roller brush frame unit 13 comprises a roller brush frame 30, a connection frame 40, and a resilient connection element 50 connected between the roller brush frame 30 and the connection frame 40.

Figure 7:
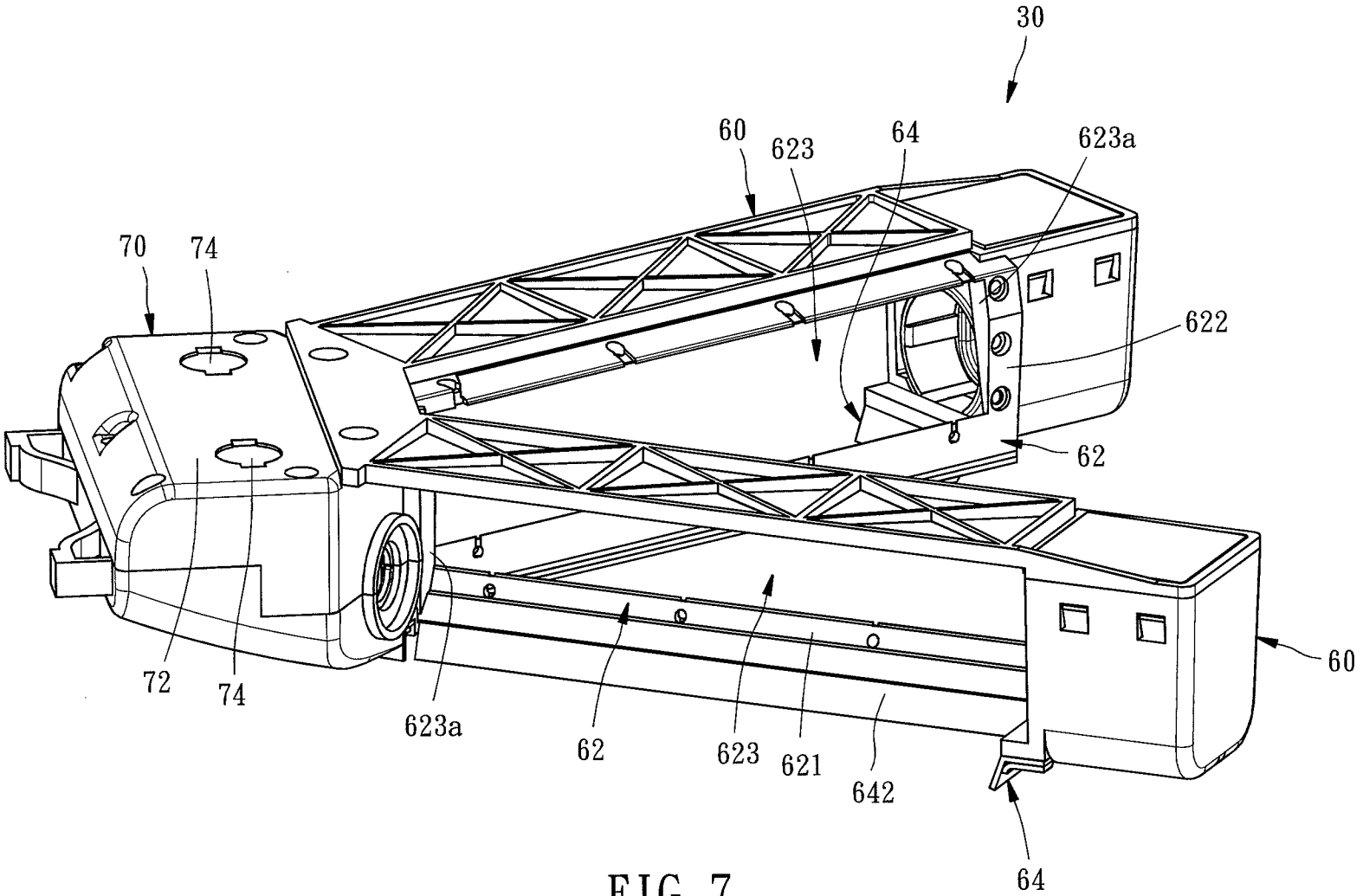
FIG. 7 is a perspective view of a roller brush frame of the roller brush frame unit according to the preferred embodiment of the present invention.

The roller brush frame 30 has two receiving portions 60 and a driving portion 70 disposed at the junction of the two receiving portions 60. The receiving portions 60 have a receiving space 61 each. A roller brush 14 is disposed in each of the receiving spaces 61. Two ends of each of the roller brushes 14 are disposed at the receiving portions 60 and the driving portion 70, respectively. A motor (not shown) for driving the two roller brushes 14 to rotate is disposed in the driving portion 70. The driving portion 70 has two conductive elements 74 exposed from a top surface 72 of the driving portion 70 and electrically connected to the motor. Furthermore, referring to FIG. 5 and FIG. 7, the receiving portions 60 each have a vertical plate 62. The vertical plates 62 each have an inner surface 621, an outer surface 622, and a through hole 623 penetrating the inner and outer surfaces 621, 622. The inner surface 621 faces the receiving space 61 of a corresponding one of the receiving portions 60. Furthermore, a guiding member 64 is disposed beneath each of the receiving portions 60. The guiding member 64 has an inclined surface 642 facing the receiving space 61. The inclined surface 642 tilts toward the receiving space 61 in a top-down direction. Hence, once the roller brushes 14 are disposed at the receiving space 61, the inclined surface 642 will face the roller brushes 14 and tilt toward the roller brushes 14 in a top-down direction.

The connection frame 40 has two vertical plates 42. The vertical plates 42 each have an inner surface 421, an outer surface 422, and a through hole 423 penetrating the inner and outer surfaces 421, 422. The two vertical plates 42 join each other with one end thereof to form a joint portion 44. A first engaging hook 46 is disposed at the joint portion 44. A second engaging hook 48 is disposed at each of the two vertical plates 42.

The resilient connection element 50 is formed from rubber by a heating and curing process, and gets connected between the roller brush frame 30 and the connection frame 40 when cured. The outer surface 622 of the vertical plates 62 of the roller brush frame 30 and the outer surface 422 of the vertical plates 42 of the connection frame 40 face each other and are spaced apart from each other by a distance. The resilient connection element 50 is mostly formed between the roller brush frame 30 and the connection frame 40 and is partially adhered and fixed to hole walls 623*a*, 423*a* of the through holes 623, 423, the inner surfaces 621, 421, and the outer surfaces 622, 422 of the vertical plates 62, 42, respectively.

The roller brush frame unit 13 is fixedly disposed at the bottom of the body 11 by means of the connection frame 40 in a manner that the first engaging hook 46 is penetratingly disposed at first grooves 227 of a bottom board 22 of the body 11, engagedly disposed at the first recess 226 (as shown in FIG. 3), penetratingly disposed at the two second grooves 229, and engagedly disposed at the two second recesses 228 by means of the two second engaging hooks 48. Therefore, the two roller brushes 14 are connected to the body 11 by means of the roller brush frame unit 13. The conductive elements 74 of the driving portion 70 of the roller brush frame 30 abut against a resilient conducting element (not shown) and thereby connect electrically to a power device (not shown) disposed inside the body 11 by means of the two resilient conducting elements. The dust-sucking and dust-collecting apparatus 12 is disposed between the inner surfaces 421 of the two vertical plates 42 of the connection frame 40. An inlet (not shown) of the dust-sucking and dust-collecting apparatus 12 is in communication with the through holes 423, 623 of the connection frame 40 and the roller brush frame 30, respectively. During the process of operation of the autonomous coverage vacuum cleaner 10, the roller brushes 14 are in contact with the floor and sweep dust and debris into the through holes 423, 623 by driving the dust and debris to drift along the inclined surface 642 of the guiding member 64, such that the dust and debris is sucked into and collected by the dust-sucking and dust-collecting apparatus 12.

More importantly, if the autonomous coverage vacuum cleaner 10 works on an uneven floor or is confronted with an obstacle, such as the edge of a carpet, an external force exerted by the floor or the obstacle on the roller brushes 14 will be indirectly transmitted to the roller brush frame 30. With the roller brush frame 30 being capable of moving vertically relative to the connection frame 40 and the body 11 because of the resilience of the resilient connection element 50, the roller brushes 14 lift and drop in order to fit the uneven surface of the floor. Therefore, the roller brushes 14 can not only pass an obstacle easily but also clean it thoroughly. Hence, the roller brush frame unit 13 enables the roller brushes 14 of the autonomous coverage vacuum cleaner 10 to lift and drop resiliently and automatically according to the condition of the floor and enhances the passage and cleaning performance of the autonomous coverage vacuum cleaner 10.

The constituent elements disclosed in the above embodiments of the present invention are illustrative of the present invention only, but should not be interpreted as restrictive of the scope of the present invention. Hence, replacements or variations of other equivalent elements should be covered by the claims of the present invention.

What is claimed is:

1. An autonomous coverage vacuum cleaner having a roller brush capable of resilient vertical displacement, comprising:

a body;

a roller brush frame unit comprising a roller brush frame, a connection frame, and a resilient connection element, the connection frame being disposed at a bottom of the body, and the resilient connection element being connected between the roller brush frame and the connection frame and being configured such that the roller brush frame moves vertically relative to the connection frame and the body when subjected to an external force; and at least one roller brush rotatably disposed at the roller brush frame, wherein the roller brush frame and the connection frame each have at least one vertical plate, the vertical plate of each of the roller brush frame and the connection frame having an outer surface, an inner surface, and a through hole penetrating the outer surface and the inner surface, wherein the outer surface of the at least one vertical plate of the roller brush frame and the outer surface of the at least the vertical plate of the connection frame face each other, and wherein the resilient connection element is adhered and fixed to inner sidewalls of the through holes, the inner surfaces, and the outer surfaces of the at least one vertical plate of the roller brush frame as well as inner sidewalls of the through holes, the inner surfaces, and the outer surfaces of the at least the vertical plate of the connection frame.

2. The autonomous coverage vacuum cleaner of claim 1, wherein the body has a bottom board, the bottom board having an upper surface, a lower surface, at least one recess formed on the upper surface, and at least one groove penetrating the upper surface and the lower surface and communicating with the recess, wherein a top portion of the connection frame has at least one engaging hook penetratingly disposed at the at least one groove of the bottom board and engagedly disposed at the at least one recess of the bottom board.

3. The autonomous coverage vacuum cleaner of claim 2, wherein the bottom board of the body has a central area and an edge, wherein the at least one recess of the bottom board comprises a first recess disposed at the central area and two second recesses disposed at the edge, wherein the at least one groove of the bottom board comprises a first groove disposed at the central area and two second grooves disposed at the edge, the first recess being in communication with the first grooves, and the two second recesses being in communication with the two second grooves, respectively, wherein the at least one engaging hook at the top portion of the connection frame comprises a first engaging hook and two second engaging hooks, the first engaging hook being penetratingly disposed at the first grooves and engagedly disposed at the first recess, and the two second engaging hooks being penetratingly disposed at the two second grooves, respectively, and engagedly disposed at the two second recesses, respectively.

4. The autonomous coverage vacuum cleaner of claim 3, wherein the connection frame has two vertical plates each having the outer surface, the inner surface, and the through hole penetrating the outer surface and the inner surface, wherein the two vertical plates join each other by an end thereof to form a joint portion, the first engaging hook being disposed at the joint portion, and the two second engaging hooks being disposed at the two vertical plates, respectively.

5. The autonomous coverage vacuum cleaner of claim 4, wherein the at least one roller brush comprises at least two roller brushes, and the roller brush frame has two receiving portions each having a receiving space for receiving therein one of the at least two roller brush, the two receiving portions each having the vertical plate, the vertical plate having the outer surface, the inner surface, and the through hole penetrating the outer surface and the inner surface, the inner surface facing the receiving space of a corresponding one of the receiving portions, wherein the outer surfaces of the vertical plates of the roller brush frame face the outer surfaces of the vertical plates of the connection frame, respectively, wherein the resilient connection element is adhered and fixed to the inner sidewalls of the through holes, the inner surfaces, and the outer surfaces of the vertical plates of the roller brush frame as well as the inner sidewalls of the through holes, the inner surfaces, and the outer surfaces of the vertical plates of the connection frame.

6. The autonomous coverage vacuum cleaner of claim 1, wherein the roller brush frame has a driving portion for driving the at least one roller brush to rotate, the driving portion having a top surface and two conductive elements exposed from the top surface.

7. The autonomous coverage vacuum cleaner of claim 6, wherein a guiding member is disposed at a bottom of the roller brush frame and has an inclined surface facing the at least one roller brush, wherein the inclined surface tilts toward the at least one roller brush in a top-down direction.

8. The autonomous coverage vacuum cleaner of claim 1, wherein a guiding member is disposed at a bottom of the roller brush frame and has an inclined surface facing the at least one roller brush, wherein the inclined surface tilts toward the at least one roller brush in a top-down direction.

* * * * *